US005117338A

United States Patent [19]

McCrary

[11] Patent Number: 5,117,338

[45] Date of Patent: May 26, 1992

[54] JEWELRY LIGHTING DEVICE

[76] Inventor: Charles F. McCrary, 1005 Wheeler Dr., Hanahan, S.C. 29406

[21] Appl. No.: 765,665

[22] Filed: Sep. 26, 1991

[51] Int. Cl.[5] ..... F21L 15/08

[52] U.S. Cl. ..... 362/104; 362/84; 362/806; 63/26

[58] Field of Search ..... 362/34, 84, 103, 104, 362/806; 63/26, 30, 32, 27

[56] References Cited

U.S. PATENT DOCUMENTS

| | | | |
|---|---|---|---|
| 3,392,276 | 7/1968 | Roman | 362/104 |
| 3,790,775 | 2/1974 | Rosenblatt | 362/104 |
| 4,012,629 | 3/1977 | Summs | 362/104 |
| 4,093,973 | 6/1978 | Voagenes | 362/104 |
| 4,551,363 | 11/1985 | Fenech | 362/104 |
| 4,846,475 | 7/1989 | Newcomb et al. | 362/84 |
| 4,855,879 | 8/1989 | Soltani et al. | 362/84 |
| 4,942,744 | 7/1990 | Wei | 63/26 |

FOREIGN PATENT DOCUMENTS

| | | | |
|---|---|---|---|
| 7900646 | 9/1979 | France | 362/104 |
| 19968 | of 1904 | United Kingdom | 362/104 |

*Primary Examiner*—Ira S. Lazarus
*Assistant Examiner*—Sue Hagarman
*Attorney, Agent, or Firm*—B. Craig Killough

[57] ABSTRACT

A lighting device mounted within a jewelry setting which is directed at a facet of a gemstone to increase the brilliance and brightness of the gemstone. The lighting means is a low dispersion, focused beam of light which is directed at a facet of a gemstone so that the gemstone captures the light. In the preferred embodiment, the lighting source is radioluminescent or electroluminescent and uses various focusing means to focus the light from the lighting means.

15 Claims, 1 Drawing Sheet

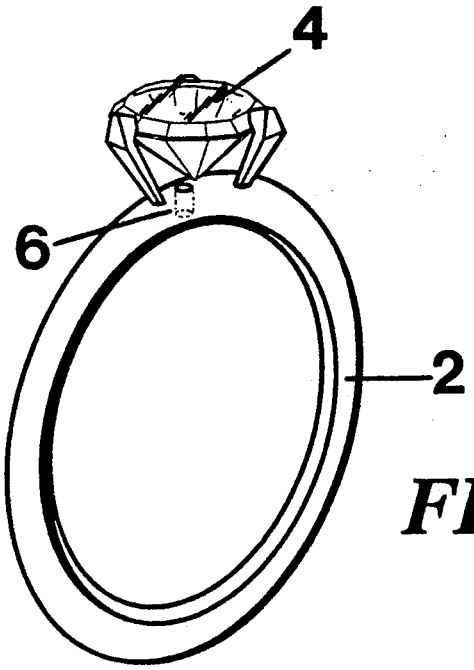
FIG 1
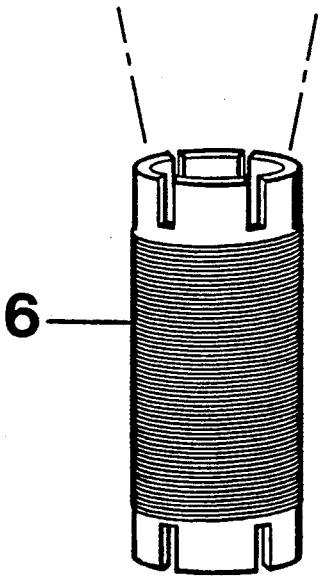
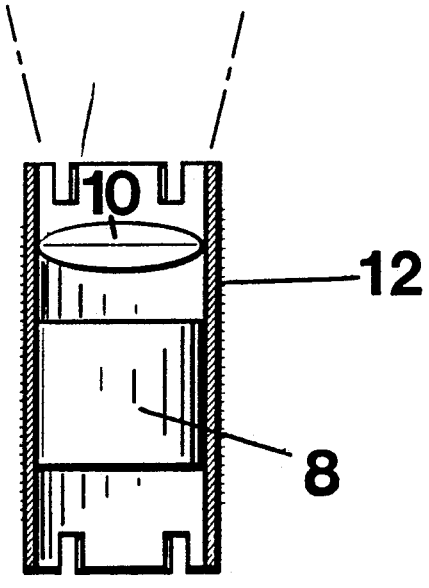
FIG 2 FIG 3

JEWELRY LIGHTING DEVICE

BACKGROUND OF THE INVENTION

The present invention pertains to jewelry in general, and is specifically directed to lighting means mounted in a jewelry setting which is used to light a gem stone mounted within the setting, to increase the brightness and brilliance of the gem stone.

Gem stones are commonly mounted to jewelry settings. Precious and semi-precious stones are mounted within settings of various materials, which are usually precious and semi-precious metals. Common examples of such jewelry are rings, bracelets, necklaces, pendants, and earrings. Brightness and brilliance are desirable characteristics and qualities which are associated with gem stones. It is highly desirable for gem stones to reflect and refract light to increase their beauty. Often, the value of a gem stone is associated with its ability to reflect and refract light clearly. Gem stones do not generate light, and the light must be provided from an external source.

The brightness and brilliance of a gem stone is affected by the cut and quality of the stone, the type of stone, as well as the available light in the environment in which the stone is worn. Unless a lighting means is provided for and directed toward the gem stone, the gem stone will reflect and refract only the light which is in the room or other environment. The brilliance and brightness of the stone will be increased if the light is directed from the setting, rather than the environment.

SUMMARY OF THE PRESENT INVENTION

The present invention provides a lighting means which is mounted in a jewelry setting in which a gem stone is mounted, with the lighting device mounted externally to the gem stone. The lighting device emits a beam of light, which is well focused at a selected facet of the gem stone, so as to strike the facet of the gem stone with very low dispersion. It is necessary for the lighting means to be relatively small, and accordingly, the amount of light which is emitted from the lighting means will be relatively low. However, a well focused beam of light, even of low power, directed at a facet of a stone from the jewelry setting of the stone will result in and yield great brilliance and brightness to the stone, particularly indoors where the ambient light is lower. Through the use of radioluminescent and electroluminescent lighting means, including electroluminescent means powered by a thermocouple deriving energy from the wearer's body heat, a satisfactory lighting of the gem stone will result.

DETAILED DESCRIPTION OF THE DRAWINGS

FIG. 1 is a perspective view of a ring 2 with a gem stone 4 mounted on the ring, with the lighting device 6 mounted within the ring setting.

FIG. 2 is a perspective view of a lighting device.

FIG. 3 is a side elevation of a jewelry lighting device, sectioned to reveal the light emitting means 8 and a lens 10.

DETAILED DESCRIPTION OF THE PREFERRED EMBODIMENT

The lighting means of the present invention may be mounted to a jewelry setting having a gem stone. As shown in FIG. 1, the jewelry setting may be a ring 2, and the gem stone may be a diamond 4.

The lighting means 6 is mounted to the jewelry setting externally to the gem stone. The lighting means 6 as shown in FIG. 1 is mounted within a void formed within the ring. The lighting means may be mounted by threaded means, by soldering, by adhesive means or other means.

The jewelry lighting device 6 is mounted externally to the gem stone 4, so that a beam of light is directed from the lighting means toward a facet of the gem stone. The beam of light is focused so as to reduce dispersion of the beam of light to an absolute minimum. The beam of light should strike a facet of the gem stone at a right angle, or no more than 45° from a right angle.

The jewelry setting could be any jewelry setting in which a gem stone is mounted. The jewelry setting could be a ring, a bracelet, a necklace, earrings, or other jewelry setting. The gem stone could be any precious or semi-precious gem stone. As used herein, gem stone means any material which could be placed within a jewelry setting and which is transparent or translucent.

In general, it is desirable that the lighting means emit as white a light as possible. If the lighting means is used to light a diamond, a white light is particularly desirable. In other applications, lighting means comprising other colors my be acceptable.

It is desired that the lighting means emit a beam of light which is as focused as possible, and that dispersion is kept to an absolute minimum, so that substantially all of the light strikes the facet of the gem stone at which the light is directed. The device should be placed externally to the gem stone, but close enough to the gem stone that 90% of the light, measured in candle power, will strike the plane of the facet of the gem stone at which the light is directed. The factors which will achieve this goal are the use of a low dispersion lighting means, placing the lighting means relatively closely to the gem stone, and focusing the beam of light on the facet.

To achieve a well focused light, a lens 10 may be placed within the lighting means. FIG. 3. The particular lens and the location of the lens relative to the light source will allow a focusing of the light on the facet.

A low dispersion lighting means may be achieved by capturing light in a tube 12. The light source 8 is placed, as is shown in FIG. 3, so that as light exits the lighting means it must pass through the tube 12. As the distance from the light source to the tube is increased, the dispersion of the light as it exits the tube is decreased.

Since the overall device as contemplated herein is relatively small, the tube will be short. Additional focusing may be accomplished by the use of as lens 10 with a convergent focus. By the use of the lens, the light may be focused so as to converge on the selected facet of the gem stone. The particular convergent lens to be used will depend on the location of the lens relative to the light source, and will be determined by the distance of the light from the facet, and the length of the tube.

Fiber optics may be used to capture light emitted by the light source, and to direct the light at the desired facet in a focused manner. Fiber optic material may be placed so as to collect light from the light source, then positioned so as to direct a beam of light at the desired facet. The fiber optic material may be placed within the tube 12, and the light emitted from the fiber optic material could be directed through the lens 10. Alternatively, the use of the tube or the lens may be dispensed with if the beam emitted from the fiber optic material is sufficiently focused.

The light source 8 may be radioluminescent. Radioluminescent, as used herein, means the production of visible light from the excitement of a material such as phosphorous, which is caused by energy imparted to the phosphorous and derived from the close proximity of the phosphorous to a radioactive material such as tritium. As the energy is supplied form the radioactive decay of the material such as tritium, the excited phosphorous emits light.

The light source may be electroluminescent. The electroluminescent light source may be powered by a battery, or by a thermocouple. A thermocouple may be used to generate a current to power the light source, with the body heat of the wearer used to provide heat energy to the thermocouple from which a current is generated to power the light source.

The light source could be any light source which will produce light from the current generated by the thermocouple. However, in the preferred embodiment, a phosphorous light source is used to produce a white light.

What is claimed is:

1. A gem stone lighting device for gem stones placed within a jewelry setting, comprising:

a. a stone which is mounted in a jewelry setting; and b. a lighting means which is mounted to said jewelry setting externally to said gem stone, wherein said lighting means emits a focused beam of light from said lighting means so that said focused beam of light strikes a facet of said gem stone at an angle of 45° to 70° to a plane of said facet.

2. A gem stone lighting device for gem stones placed within a jewelry setting as described in claim 1, wherein said lighting means is radioluminescent.

3. A gem stone lighting device for gem stones placed within a jewelry setting as described in claim 1, wherein said lighting means is electroluminescent.

4. A gem stone lighting device for gem stones placed within a jewelry setting as described in claim 2, wherein said lighting means further comprises a focusing means to focus said focus beam of light to reduce dispersion of said beam of light so that not less than 90% of said light measured in candle power strikes said facet of said gem stone.

5. A gem stone lighting device for gem stones placed within a jewelry setting as described in claim 3, wherein said lighting means further comprises a focusing means to focus said focus beam of light to reduce dispersion of said beam of light so that not less than 90% of said light measured in candle power strikes said facet of said gem stone.

6. A gem stone lighting device for gem stones placed within a jewelry setting as described in claim 3, wherein said electroluminescent means is powered by a current generated by a thermocouple using body heat from a wearer of said jewelry setting to generate said current.

7. A gem stone lighting device for gem stones placed within a jewelry setting as described in claim 5, wherein said electroluminescent means is powered by a current generated by a thermocouple using body heat from a wearer of said jewelry setting to generate said current.

8. A gem stone lighting device for gem stones placed within a jewelry setting, comprising:

a. a stone which is mounted in a jewelry setting; and, b. a lighting means which is mounted to said jewelry setting externally to said gem stone, and which is directed at said gem stone, wherein said lighting means comprises a tube having a light source therein, with light emitted from said light source traveling through said tube and out of open end of said tube so as to decrease dispersion of said light from said light source as said light travels through said tube, the said light emitted from said tube striking a facet of said gem stone.

9. A gem stone lighting device for gem stones placed within a jewelry setting as described in claim 8, wherein said tube has a convergent lens present therein which is positioned between said light source and said open end of said tube, and through which said light passes so as to focus on said facet of said gem stone.

10. A gem stone lighting device for gem stones placed within a jewelry setting as described in claim 8, wherein said light source is radioluminescent.

11. A gem stone lighting device for gem stones placed within a jewelry setting as described in claim 8, wherein said light source is electroluminescent.

12. A gem stone lighting device for gem stones placed within a jewelry setting as described in claim 9, wherein said light source is radioluminescent.

13. A gem stone lighting device for gem stones placed within a jewelry setting as described in claim 9, wherein said light source is electroluminescent.

14. A gem stone lighting device for gem stones placed within a jewelry setting as described in claim 11, wherein said electroluminescent light source is powered by a current generated byu a thermocouple using body heat from a wearer of said jewelry setting to generate said current.

15. A gem stone lighting device for gem stones placed within a jewelry setting as described in claim 13, wherein said electroluminescent light source is powered by a current generated by a thermocouple using body heat from a wearer of said jewelry setting to generate said current.

* * * * *